US009565882B2

(12) United States Patent
Kano

(10) Patent No.: US 9,565,882 B2
(45) Date of Patent: Feb. 14, 2017

(54) DYED REGENERATED COLLAGEN FIBER, ARTIFICIAL HAIR, AND METHOD FOR DYE-FIXING TREATMENT OF DYED REGENERATED COLLAGEN FIBER

(75) Inventor: Aki Kano, Takasago (JP)

(73) Assignee: KANEKA CORPORATION, Osaka (JP)

( * ) Notice: Subject to any disclaimer, the term of this patent is extended or adjusted under 35 U.S.C. 154(b) by 321 days.

(21) Appl. No.: 12/295,585

(22) PCT Filed: Apr. 2, 2007

(86) PCT No.: PCT/JP2007/057373
§ 371 (c)(1),
(2), (4) Date: Jan. 9, 2009

(87) PCT Pub. No.: WO2007/114422
PCT Pub. Date: Oct. 11, 2007

(65) Prior Publication Data

US 2009/0173356 A1 Jul. 9, 2009

(30) Foreign Application Priority Data

Mar. 31, 2006 (JP) ..... 2006-100929

(51) Int. Cl.

| | |
|---|---|
| ***A41G 3/00*** | (2006.01) |
| ***D01F 4/00*** | (2006.01) |
| ***D06P 1/38*** | (2006.01) |
| ***D06P 1/52*** | (2006.01) |
| ***D06P 3/04*** | (2006.01) |
| ***D06P 5/08*** | (2006.01) |

(52) U.S. Cl.
CPC ..... *A41G 3/0083* (2013.01); *D01F 4/00* (2013.01); *D06P 1/5278* (2013.01); *D06P 3/04* (2013.01); *D06P 5/08* (2013.01)

(58) Field of Classification Search
CPC ..... D06P 1/5278; D06P 3/04; D06P 5/08; A41G 3/0083; D01F 4/00
USPC ..... 8/404, 506, 916, 127.5, 685
IPC ..... D06P 1/5278, 3/04, 5/08
See application file for complete search history.

(56) References Cited

U.S. PATENT DOCUMENTS

| | | | | |
|---|---|---|---|---|
| 2,622,075 | A * | 12/1952 | Hemmi et al. | 8/442 |
| 3,562,381 | A | 2/1971 | Sakurada et al. | |
| 4,056,354 | A * | 11/1977 | Pittman et al. | 8/533 |
| 4,520,143 | A * | 5/1985 | Jellinek | 523/410 |
| 5,013,328 | A * | 5/1991 | Annen et al. | 8/442 |
| 5,571,291 | A | 11/1996 | Koike | |
| 5,908,474 | A | 6/1999 | Danner et al. | |
| 6,160,096 | A | 12/2000 | Sakashita et al. | |
| 6,242,573 | B1 * | 6/2001 | Goto et al. | 530/356 |
| 2003/0167575 | A1 | 9/2003 | Connolly et al. | |

FOREIGN PATENT DOCUMENTS

| | | | |
|---|---|---|---|
| JP | 43-12633 | B1 | 5/1968 |
| JP | 50-145674 | | 11/1975 |
| JP | 55-163289 | A | 12/1980 |
| JP | 01-111082 | A | 4/1989 |
| JP | 2-216282 | A | 8/1990 |
| JP | 05-027454 | A | 2/1993 |
| JP | 5-27454 | Y | 7/1993 |
| JP | 06-146177 | A | 5/1994 |
| JP | 7-126988 | A | 5/1995 |
| JP | 08-296179 | A | 11/1996 |
| JP | 11-505576 | A | 5/1999 |
| JP | 11-323727 | A | 11/1999 |
| JP | 2000-34675 | A | 2/2000 |
| JP | 2000-199176 | A | 7/2000 |
| JP | 2002-034675 | A | 2/2002 |
| JP | 2003-535231 | A | 11/2003 |
| JP | 2006-037325 | A | 2/2006 |

OTHER PUBLICATIONS

Hu et al., "Progress on Crosslinking Dyes", Dyestuffs and Coloration, vol. 41, No. 3, Jun. 30, 2004, pp. 128-130.
Japanese Office Action issued in corresponding Japanese Patent Application No. 2008-302089 issued May 15, 2012.
Japanese Office Action issued in corresponding Japanese Patent Application No. 2008-302809 issued May 15, 2012.

* cited by examiner

*Primary Examiner* — Amina Khan
(74) *Attorney, Agent, or Firm* — Sughrue Mion, PLLC

(57) ABSTRACT

A dyed regenerated collagen fiber of the invention is a regenerated collagen fiber dyed with a dye having an excellent dye fastness. An aspect of the invention is directed to a dyed regenerated collagen fiber including at least one kind of compound selected from the group consisting of polyalkylenepolyamine compounds, condensation compounds of polyalkylenepolyamine and dicyandiamide, and acid addition salt compounds of the condensation compounds.

6 Claims, No Drawings

DYED REGENERATED COLLAGEN FIBER, ARTIFICIAL HAIR, AND METHOD FOR DYE-FIXING TREATMENT OF DYED REGENERATED COLLAGEN FIBER

TECHNICAL FIELD

The present invention relates to a dyed regenerated collagen fiber, artificial hair having excellent dye fastness, and a method for fixing a dye in a dyed regenerated collagen fiber.

BACKGROUND ART

A regenerated collagen fiber, as a protein fiber, is close to human hair in various properties, and accordingly is suitably used as a raw material for artificial hair. High aesthetic properties such as color appearance and texture are demanded in a fiber for use as a raw material for artificial hair.

Protein fibers are generally colored according to a dyeing method. As the dyeing method, there is used a dyeing method comprising immersing protein fibers in a dye aqueous solution in a temperature range of 70 to 100° C.

Specifically, for instance, D1 recites a dyeing method comprising: immersing wool in a dye aqueous solution containing an enzyme or a like compound for enhancing the dye leveling; and boiling the solution at 100° C. for 60 minutes.

D2 recites a method for dyeing protein fibers such as wool, cashmere wool, and silk threads, with use of a specific treating agent, in a temperature range of 70 to 90° C., which is lower than a conventional dyeing temperature. In Examples of D2, there is disclosed an example, wherein wool is treated with a specific treating agent, and the treated wool is dyed at a dyeing temperature of 85° C.

As described above, in the conventional general protein fiber dyeing method, a high-temperature treatment over 70° C. has been required to allow the protein fibers to sufficiently exhaust the dye, even in use of a specific treating agent.

In the case where regenerated collagen fibers are dyed by a dyeing method such as requiring a high-temperature condition over 70° C., the regenerated collagen fibers may shrink.

In order to solve the above drawback, the inventor has tried to dye regenerated collagen fibers at a temperature of 70° C. or lower. However, in the case where the dyeing temperature is low, chemical reaction of regenerated collagen fibers and a dye is insufficient, which may lower the dye fastness. Also, in the case where regenerated collagen fibers having low dye fastness is used as artificial hair, the dye in the regenerated collagen fibers may be transferred to a garment in contact with the regenerated collagen fibers by way of water such as sweat.

In view of the above, as a method for coloring regenerated collagen fibers, a method comprising dispersing a pigment such as carbon black for coloring in a solution spinning process for producing regenerated collagen fibers has been a solely practical method. However, in the coloring method using a pigment, a possible color range obtained by the coloring has been limited to achromatic colors such as black and gray, and it has been difficult to obtain vivid color appearance on chromatic colors such as red, yellow, blue, and purple, as well as deep black or the like.

D1: Japanese Unexamined Patent Publication No. Hei 2-216282

D2: Japanese Unexamined Patent Publication No. Hei 7-126988

DISCLOSURE OF THE INVENTION

In view of the above, it is an object of the invention to provide dyed regenerated collagen fibers, having excellent dye fastness, particularly, excellent dye fastness against sweat.

An aspect of the invention is directed to a regenerated collagen fiber containing at least one kind of a compound selected from the group consisting of polyalkylenepolyamine compounds, condensation compounds of polyalkylenepolyamine and dicyandiamide, and acid addition salt compounds of the condensation compounds.

BEST MODE FOR CARRYING OUT THE INVENTION

In the following, a dyed regenerated collagen fiber embodying the invention is described in detail.

A regenerated collagen fiber in the embodiment is a dyed regenerated collagen fiber containing at least one kind of a compound selected from the group consisting of polyalkylenepolyamine compounds, condensation compounds of polyalkylenepolyamine and dicyandiamide, and acid addition salt compounds of the condensation compounds.

Regenerated collagen fibers are acquired by: ejecting a solubilized collagen solution to be obtained by subjecting a collagen raw material to solubilization, into an inorganic salt aqueous solution for precipitation of regenerated collagen fibers; and subjecting the regenerated collagen fibers to insolubilization by a mono-functional epoxy compound or a like compound. The regenerated collagen fibers are particularly preferably regenerated collagen fibers derived from bovine hide. The regenerated collagen fibers derived from bovine hide are particularly preferably used as artificial hair in the aspect of availability.

Specific examples of the regenerated collagen fiber include fiber powders, fiber filaments, staple fibers, and yarn-like fibers obtained by spinning staple fibers. Also, it is possible to use fabrics or strings obtained by weaving or knitting the regenerated collagen fibers alone or in combination, as well as non-woven fabrics containing the regenerated collagen fibers alone or in combination. A method for producing the regenerated collagen fibers will be described later in detail.

A dye for dyeing the regenerated collagen fibers is not specifically limited. Preferably, however, at least one kind of a dye selected from the group consisting of 1:1 type metal complex salt dyes, 1:2 type metal complex salt dyes, leveling acid dyes, milling acid dyes, chrome dyes, and reactive dyes is used in the aspect of dye exhaustion into regenerated collagen fibers.

The 1:1 type metal complex salt dye is a dye of a chemical formula, wherein the dye has 1 or 2 sulfonic acid group, and one metal atom such as chrome or cobalt is coordinately bonded to one dye molecule.

Specific representative examples of the 1:1 type metal complex salt dye include Neolan of Ciba Specialty Chemicals, and Palatin Fast of Mitsui BASF Dyes Ltd. Among these, Neolan is particularly preferred in the aspect of dye exhaustion into regenerated collagen fibers.

The 1:2 type metal complex salt dye is a dye of a chemical formula, wherein one metal atom such as chrome or cobalt is coordinately bonded to two dye molecules. The dye may or may not have a sulfonic acid group.

Specific representative examples of the 1:2 type metal complex salt dye without a sulfonic acid group include Irgalan of Ciba Specialty Chemicals, Lanyl of Sumitomo Chemical Co. Ltd, Kayakalan of Nippon Kayaku Co. Ltd., Lanafast and Acidol of Mitsui BASF Dyes Ltd, Aizen Anilon of Hodogaya Chemical Co. Ltd., Isolan K of Dystar Japan Ltd., and Lanasyn of Clariant Japan K.K. Specific representative examples of the 1:2 type metal complex salt dye with a sulfonic acid group include Lanacron S of Ciba Specialty Chemicals, Lanyl W of Sumitomo Chemical Co. Ltd., Kayalax of Nippon Kayaku Co. Ltd., Acidol M of Mitsui BASF Dyes Ltd, Isolan S of Dystar Japan Ltd., and Lanasyn S of Clariant Japan K.K. Among these, dyes without a sulfonic acid group, particularly, Irgalan is preferred in the aspect of dye exhaustion into regenerated collagen fibers.

The leveling acid dye is a water-soluble anionic dye having a relatively small molecular weight, a high affinity to polyamide fibers such as wool or nylon, and a low affinity to cellulose fibers. Specific representative examples of the leveling acid dye include Telon and Supranol of Dystar Japan Ltd., Suminol Leveling and Aminyl E of Sumitomo Chemical Co. Ltd., Kayacyl of Nippon Kayaku Co. Ltd., Mitsui Acid, Mitsui Nylon Fast, and Nylomine A/B of Mitsui BASF Dyes Ltd, Tection of Ciba Specialty Chemicals, and Sandlan E and Nylosan E of Clariant Japan K.K. Among these, Telon is preferred in the aspect of dye exhaustion into regenerated collagen fibers.

Specific representative examples of the milling acid dye include Suminol Milling of Sumitomo Chemical Co. Ltd., Kayanol Milling of Nippon Kayaku Co., Ltd., Mitsui Acid Milling and Carbolan of Mitsui BASF Dyes Ltd, Polar of Ciba Specialty Chemicals, and Sandlan Milling of Clariant Japan K.K. Among these, Suminol Milling is preferred in the aspect of dye exhaustion into regenerated collagen fibers.

The chrome dye is a dye with a chemical formula, wherein the dye has 1 or 2 sulfonic acid group, and has a group capable of forming a metal complex salt primarily by a trivalent chromium. The chrome dye is also called as an acid mordant dye, and is a dye having excellent wet fastness and light fastness.

Specific examples of the chrome dye include Dimond of Dystar Japan Ltd.

The reactive dye is a dye which exhibits dyeing characteristics by covalent bonding through reaction with a functional group in a fiber.

Examples of the functional group to be included in the reactive dye include a vinylsulfone group and a chlorotriazine group.

Specific representative examples of the reactive dye include reactive dyes having a vinylsulfone group such as Lanasol and Eriofast of Ciba Specialty Chemicals, and Levafix E and Remazol of Dystar Japan Ltd.; and reactive dyes having a chlorotriazine group such as Cibacron of Ciba Specialty Chemicals. Among these, reactive dyes having a vinylsulfone group, particularly, Lanasol and Remazol are preferred in the aspect of less likelihood of hydrolysis even in an acidic condition, and dye exhaustion into regenerated collagen fibers.

It is preferred to prepare a dye aqueous solution for obtaining an intended color by using, among the above-mentioned dyes, particularly, one kind of a dye selected from the group consisting of 1:1 type metal complex salt dyes, 1:2 type metal complex salt dyes, and reactive dyes, wherein the dye is multiple different dyes belonging to the selected species. The above approach is particularly preferred, because the individual dyes to be included in the dye aqueous solution are easily exhausted in regenerated collagen fibers, and greater latitude is provided in adjusting the colors to obtain an intended color.

The dyed regenerated collagen fibers in the embodiment are obtained, for instance, by: preparing a dye aqueous solution containing at least one kind of a dye selected from the group consisting of 1:1 type metal complex salt dyes, 1:2 type metal complex salt dyes, leveling acid dyes, milling acid dyes, chrome dyes, and reactive dyes; and immersing regenerated collagen fibers in the dye aqueous solution for a predetermined time in a temperature range of 30 to 70° C., preferably 50 to 70° C., and more preferably 55 to 65° C. for dyeing.

The dye aqueous solution is allowed to have an adjusted dye composition ratio and an adjusted dye concentration for obtaining an intended color by dissolving the dyes in hot water; or dissolving the dyes in water by double-boiling in a bowl containing a hot water.

Water, as a solvent of the dye aqueous solution, may be industrial water or high-purity water such as ion-exchanged water.

It is preferred to properly adjust the pH of the dye aqueous solution in the range of pH 2 to 10, and more preferably pH 2.5 to 10. Adjusting the pH of the dye aqueous solution in the above range is advantageous in suppressing fiber shrinkage resulting from fiber denaturalization, or lowering of a mechanical property of fiber resulting from hydrolysis of fiber. Examples of the pH adjuster include formic acid, acetic acid, sulfuric acid, sodium hydroxide, and sodium carbonate.

The pH range suitable for the aforementioned dyes is: 2 to 4, preferably 2.5 to 4, and more preferably 2.5 to 3.5 in case of using a 1:1 type metal complex salt dye; 3 to 7, and preferably 4 to 7 in case of using a 1:2 type metal complex salt dye; and 3 to 5, and preferably 3.5 to 4.5 in case of using a leveling acid dye; 3 to 5, and preferably 3.5 to 4.5 in case of using a chrome dye; and 3 to 10, and preferably 4 to 9 in case of using a reactive dye.

Next, a method for immersing regenerated collagen fibers in a dye aqueous solution is described.

Regenerated collagen fibers are immersed in the dye aqueous solution prepared as described above.

In the case where an oil or a like substance is adhered to the regenerated collagen fibers to be immersed in an oiling step during a spinning operation, it is preferred to remove, in advance, the adhered oil or like substance by a refining step. Removing the oil in advance is advantageous in enhancing dye exhaustion and dye fastness.

The refining step is performed by immersing the regenerated collagen fibers in an aqueous solution containing a surfactant of a predetermined concentration to be used in the refining step in a water temperature range of 40 to 50° C. for a predetermined time e.g. 5 to 20 minutes.

Then, the regenerated collagen fibers are immersed in the dye aqueous solution. The liquid temperature of the dye aqueous solution is preferably in the range of 30 to 70° C. The aforementioned dyes are sufficiently exhausted in the regenerated collagen fibers even in a low temperature range of 30 to 70° C. Since the above treatment enables to suppress fiber shrinkage resulting from denaturalization of regenerated collagen fibers, dyeing can be performed without degrading the texture of the regenerated collagen fibers. In the case where the regenerated collagen fibers are dyed in a dye aqueous solution at a liquid temperature higher than 70° C., as in the conventional dyeing method, the regenerated collagen fibers may be denatured, and considerably shrink. This may obstruct usage of the dyed regenerated collagen fibers as artificial hair requiring an aesthetic property. Dyeing the regenerated collagen fibers in a dye aqueous solution of 70° C. or less, as described above, enables to suppress fiber shrinkage, and provide practical use of the dyed regenerated collagen fibers as artificial hair requiring an aesthetic property. In the case where the temperature of the dye aqueous solution is lower than 30° C., a long time may be required for dyeing, and the dye exhaustion rate may be lowered.

Preferably, the bath ratio of the regenerated collagen fibers to the dye aqueous solution is about 1:10 to 1:100, and more preferably about 1:20 to 1:60 in the aspect of increasing the exhaustion speed.

The regenerated collagen fibers are immersed in the dye aqueous solution until the dyes are exhausted with a predetermined dye composition ratio for e.g. about 30 to 120 minutes, and then, the dyed regenerated collagen fibers are taken out from the dye aqueous solution.

Next, a dye fixing treatment is performed by infiltrating at least one kind of a compound selected from the group consisting of polyalkylenepolyamine compounds, condensation compounds of polyalkylenepolyamine and dicyandiamide, and acid addition salt compounds of the condensation products into the dyed regenerated collagen fiber. These compounds act as a fixing agent for fixing the exhausted dyes in the regenerated collagen. Regenerated collagen fibers dyed at a relatively low temperature have relatively low dye fastness. Further, it is impossible to sufficiently enhance dye fastness with use of a conventional fixing agent for use in dyed protein fibers, such as aluminum sulfate, aluminum carbonate, a tannin compound, or a dicyandiamide compound. Use of the aforementioned compound as a fixing agent, however, enables to impart high dye fastness to the dyed regenerated collagen fibers.

An example of the dye fixing treatment comprises: immersing the dyed collagen fibers in an aqueous solution containing the aforementioned compound for a predetermined time; taking out the dyed collagen fibers from the aqueous solution; and drying the dyed collagen fibers at a predetermined temperature.

Examples of the polyalkylenepolyamine compound include polyalkylenepolyamines such as polymethylenepolyamine and polyethylenepolyamine. Commercially available examples of the polyalkylenepolyamine compound include fix oil RGS of Meisei Chemical Works, Ltd.

Specific examples of the condensation compound of polyalkylenepolyamine and dicyandiamide, or the acid addition salt thereof include a condensation compound of diethylenetriamine and dicyandiamide, and a condensation compound of triethylenetetraamine and dicyandiamide. Examples of the acid addition salt of the condensation compound include mineral acid salts such as hydrochlorides and hydrosulfates of the condensation compound, and organic acid salts such as acetates and oxalates of the condensation compound.

Conceivably, the dye fastness enhancing effect by polyalkylenepolyamine compounds, condensation compounds of polyalkylenepolyamine and dicyandiamide, or acid addition salts of the condensation compounds with respect to dyed regenerated collagen fibers is obtained, because dye elution is prevented by ion-bonding of the aforementioned compound to a dye, and bonding of the aforementioned compound to a regenerated collagen fiber through van der Waals force, hydrogen-bonding, coordinate bonding, or chemical bonding, thereby fixing the dye. In particular, since the aforementioned compound forms a strong hydrogen bond to a carboxyl group in the regenerated collagen fiber, it is conceived that the dye fixing effect is large. Also, in the case where mixture of tannin and tartar emetic is used as a fixing agent, it is conceived that elution of the dye from the interior of the fiber is prevented, because the mixture forms a skin on the outer layer of the fiber. However, in the case where there remains a large amount of unreacted or unfixed dye even in use of the mixture, it is conceived that the fixing effect is low.

The polyalkylenepolyamine compounds, the dicyandiamide compounds, the condensation compounds of polyalkylenepolyamine and dicyandiamide, and the acid addition salts of the condensation compounds may be used alone or in combination of two or more. In this case, it is preferred to sequentially immerse the regenerated collagen fibers in the respective aqueous solutions of the aforementioned compounds.

The liquid temperature of the aqueous solution of the aforementioned compound is 50 to 70° C., and preferably 55 to 65° C., and the immersion time is preferably 10 to 30 minutes. Treating the dyed regenerated collagen fibers in the above condition is advantageous in suppressing fiber shrinkage. The pH of the aqueous solution of the aforementioned compound is preferably about 5 to 10, more preferably about 8 to 10, and particularly preferably about 8.5 to 9.5 in the aspect of increasing bonding of the aforementioned compound to the dye or the regenerated collagen fiber, and dye fastness.

The concentration of the aqueous solution of the aforementioned compound is preferably 1 to 10% by mass, and more preferably 2 to 5% by mass in the aspect of sufficiently increasing dye fastness.

The concentration of the aforementioned aqueous solution is relatively high, as compared with the concentration (e.g. less than 1%) of a fixing agent aqueous solution used in the conventional fiber treatment. This is because regenerated collagen fibers are likely to absorb water because of a high affinity to water, and even if a dye is exhausted in the regenerated collagen fibers with a large exhaustion rate, the temporarily exhausted dye is likely to re-dissolve in water and be eluted with water. In view of this, treating the regenerated collagen fibers in the aqueous solution of the aforementioned compound having a relatively large concentration is advantageous in suppressing re-dissolution of the exhausted dye, and increasing dye fastness.

The regenerated collagen fibers immersed in the aforementioned fixing agent aqueous solution for a predetermined time are taken out from the fixing agent aqueous solution, rinsed with water, dewatered, and dried.

The application amount of the aforementioned compound to the regenerated collagen fibers is preferably about 1 to 20% omf, and more preferably about 3 to 15% omf in the aspect of sufficiently increasing dye fastness.

Next, a method for producing regenerated collagen fibers is described in detail.

For instance, a part of split leather of animal is used as a collagen raw material for obtaining regenerated collagen fibers. Examples of the split leather include fresh split leathers obtained by slaughtering animals such as bovines, and split leathers obtained from salted raw hides. Split leathers are primarily constituted of insoluble collagen fibers. Normally, the split leathers are used after a fibrous flesh adhered to the skin is removed, or a salt for use in preventing the flesh from rotting or degrading is removed.

The insoluble collagen fibers obtained by the aforementioned treatment contain impurities including lipids such as glycerides, phospholipids, unesterified fatty acids, and proteins other than collagens such as sugar proteins and albumin.

These impurities may adversely affect yarn spinning stability in manufacturing fibers, fiber quality such as luster or elongation degree, odor, or the like. In view of this, it is preferable to remove the impurities in advance by preserving the insoluble collagen fibers in limewater to hydrolyze a fatty component for untangling of the collagen fibers, followed by a leather treatment such as acid treatment, alkali treatment, enzyme treatment, or solvent treatment.

Next, the insoluble collagen applied with the leather treatment is solubilized by cutting crosslink of peptides. Examples of the solubilization include alkali solubilization and enzyme solubilization.

It is preferable to perform pH adjustment, salting out, water-rinsing, solvent treatment, or a like treatment with respect to the solubilized collagen to obtain regenerated collagen of less impurity.

The solubilized collagen is dissolved with an acidic solution whose pH is adjusted in the range of 2 to 4.5 by an acid such as hydrochloric acid, acetic acid, lactic acid or a like acid so that a stock solution of e.g. about 1 to 15% by mass, and preferably about 2 to 10% by mass is obtained. An additive such as a stabilizer or a water-soluble polymeric compound may be added to the solubilized collagen aqueous solution, according to needs, for improvement of mechanical strength, improvement of water resistance or heat resistance, improvement of luster, improvement of yarn spinning performance, color protection, antisepsis, and the like.

The solubilized collagen aqueous solution is ejected into an inorganic salt aqueous solution through e.g. a yarn spinning nozzle or a slit to form regenerated collagen fibers.

Preferred examples of the inorganic salt aqueous solution include an aqueous solution containing a water-soluble inorganic salt such as sodium sulfate, sodium chloride, or ammonium sulfate in the content of 10 to 40% by mass.

Preferably, the regenerated collagen fibers are insolubilized by crosslinking with a mono-functional epoxy compound or a like compound.

Specific examples of the mono-functional epoxy compound include: olefin oxides such as ethylene oxide, propylene oxide, butylene oxide, isobutylene oxide, octene oxide, styrene oxide, methylstyrene oxide, epichlorohydrin, epibromohydrin, and glycidol; glicidyl ethers such as glicidyl methylether, butyl glicidyl ether, octyl glicidyl ether, nonyl glicidyl ether, undecyl glicidyl ether, tridecyl glicidyl ether, pentadecyl glicidyl ether, 2-ethylhexyl glicidyl ether, allyl glicidyl ether, phenyl glicidyl ether, cresyl glicidyl ether, t-butylphenyl glicidyl ether, dibromophenyl glicidyl ether, benzyl glicidyl ether, and polyethyleneoxide glicidyl ether; glicidyl esters such as glicidyl formate, glicidyl acetate, glicidyl acrylate, glicidyl methacrylate, and glicidyl benzoate; and glicidyl amides. Among the mono-functional epoxy compounds, a mono-functional epoxy compound represented by the following general formula (I) is preferably used to advantageously lower the water absorption coefficient of regenerated collagen fibers.

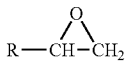

(I)

where R is a substituent represented by $R^1$—, $R^2$—O—$CH_2$—, or $R^2$—COO—$CH_2$—, $R^1$ in the substituent is a hydrocarbon group having 2 or more carbon atoms or $CH_2Cl$, and $R^2$ is a hydrocarbon group having 4 or more carbon atoms.

Specific examples of the compound represented by the general formula (I) include butylene oxide, isobutylene oxide, styrene oxide, epichlorohydrin, butyl glicidyl ether, octyl glicidyl ether, and glicidyl methacrylate; however, are not specifically limited thereto.

Further, mono-functional epoxy compounds such as butylene oxide or epichlorohydrin, where $R^1$ in the general formula (I) is a hydrocarbon group having 2 to 6 carbon atoms or $CH_2Cl$; and butyl glicidyl ether or phenyl glicidyl ether, where $R^2$ in the general formula (I) is a hydrocarbon group having 4 to 6 carbon atoms are particularly preferably used, because reactivity is high, short-time treatment is possible, treatment in water is relatively easy, or a like reason.

The amount of mono-functional epoxy compound to be used is 0.1 to 500 equivalents with respect to the amount of amino group reactable with a mono-functional epoxy group in a regenerated collagen fiber, preferably 0.5 to 100 equivalents, and more preferably 1 to 50 equivalents. The amount of amino group is measured by an amino acid analysis method. In the case where the amount of mono-functional epoxy compound is smaller than 0.1 equivalent, the insolubilization effect of regenerated collagen fibers with respect to water is insufficient. On the other hand, in the case where the amount of mono-functional epoxy compound is larger than 500 equivalents, it is not preferred in the aspect of industrial operability or environment despite a satisfactory insolubilization effect.

In use of the mono-functional epoxy compound, the mono-functional epoxy compound is dissolved in water as a reaction solvent.

In the treatment by a mono-functional epoxy compound, the salting out effect of a treating solution with respect to collagen fibers is apt to be lowered significantly, as the pH of the treating solution is away from the vicinity of neutrality, corresponding to an isoelectric point of collagen fibers. In particular, lowering of the salting out effect is significantly large in a high pH range where the reaction speed of mono-functional epoxy compound and collagen amino group is significantly increased. As a result, the collagen fibers may be swollen, and peptide bonds are likely to be hydrolyzed. Consequently, the water absorption coefficient of the produced fibers may be increased, which may obstruct production of fibers having an intended physical property e.g. a water absorption coefficient of 100% or less. In view of this, it is necessary to add an inorganic salt, depending on the added amount of sodium hydroxide, in such an amount that the water absorption coefficient of resultant regenerated collagen fibers is 100% or less before the treatment by a mono-functional epoxy compound is started.

Examples of the inorganic salt include sodium sulfate, sodium chloride, and ammonium sulfate. Among these, sodium sulfate is preferred in the aspect of industrial operability.

The amount of inorganic salt capable of setting the water absorption coefficient of resultant regenerated collagen fibers to 100% or less corresponds to an inorganic salt concentration range, in which swelling of collagen fibers is suppressed, collagen fibers are easily salted out, and the moisture content of collagen fibers is 260% or less in a predetermined temperature and pH range, although the amount of inorganic salt differs depending on the kind of inorganic salt, the ambient temperature, pH, or a like parameter. The amount of inorganic salt to be added can be determined by measuring a swelling degree of regenerated collagen fibers to be used in the treating solution, or the moisture content. The swelling degree is preferably set to such a value that the thickness of regenerated collagen fibers can be visually evaluated, and the regenerated collagen fibers may not be exceedingly swollen before being put into a reaction solution.

Specifically, in the case where the concentration of sodium hydroxide in the reaction solution is not smaller than 0.001N and smaller than 0.05N, the amount of inorganic salt to be added is 13% by mass or more, preferably 15% by mass or more, and more preferably 17% by mass or more. In the case where the concentration of sodium hydroxide in the reaction solution is not smaller than 0.05N and smaller than 0.15N, the amount of inorganic salt to be added is 15% by mass or more, preferably 17% by mass or more, and more preferably 19% by mass or more. In the case where the concentration of sodium hydroxide in the reaction solution is not smaller than 0.15N and smaller than 0.35N, the amount of inorganic salt to be added is 16% by mass or more, and preferably 19% by mass or more. In the case where the concentration of sodium hydroxide in the reaction solution is not smaller than 0.35N and not larger than 0.8N, the amount of inorganic salt to be added is required to be 19% by mass or more. The upper limit of the amount of inorganic salt to be added corresponds to a saturated concentration at 25° C. In the case where the concentration of inorganic salt is out of the aforementioned range, the salting out effect of a treating solution with respect to collagen fibers is significantly decreased. As a result, the collagen fibers may be swollen, and peptide bonds are likely to be hydrolyzed. Consequently, the water absorption coefficient of resultant fibers may exceed 100%, and production of fibers having an intended physical property may be obstructed.

The water absorption coefficient of resultant regenerated collagen fibers is 100% or less, and preferably 90% or less. In the case where the water absorption coefficient is larger than 100%, the fibers in a wet condition may lose their hardness, and the ability of keeping a shape such as curl is apt to be weakened.

Further, the regenerated collagen fibers may be rinsed with water, according to needs. Water-rinsing is advantageous in removing an inorganic salt, an unreacted mono-functional epoxy compound, and a mono-functional-epoxy-compound-derived decomposed matter, which has been adhered or adsorbed thereto, from the regenerated collagen fibers.

Preferably, the regenerated collagen fibers to be used in the invention may be fibers obtained by tanning the aforementioned regenerated collagen fibers with a well-known metal salt, specifically, immersing the regenerated collagen fibers in an aluminum salt aqueous solution, a chromium salt aqueous solution, or a zirconium salt aqueous solution. By performing the treatment, the regenerated collagen fibers in a wet condition are provided with a sufficient hardness, an improved wet sensation, and a desirable shaping performance such as curl-setting.

As an example of tanning with a metal salt, treatment in an aluminum salt aqueous solution is particularly preferred. In the case where regenerated collagen fibers treated with a metal tanning in an aluminum salt aqueous solution are dyed, translucent colors can be obtained. The above metal tanning is particularly preferred in the aspect of providing excellent color appearance on chromatic colors.

The treatment with a metal aluminum salt is performed in such a manner that the aluminum salt to be included in the fibers after the treatment is preferably 2 to 40% by mass, and more preferably 5 to 20% by mass in the conversion of aluminum oxide ($Al_2O_3$). In the case where the amount of aluminum salt to be included in the regenerated collagen fibers is smaller than 2% by mass in the conversion of oxide aluminum, the wet sensation may be degraded, and the shaping performance such as curl setting may be weakened. In the case where the amount of aluminum salt to be included in the regenerated collagen fibers is larger than 40% by mass in the conversion of oxide aluminum, the fibers after the treatment may be stiff, which may impair the fiber texture.

The kind of aluminum salt to be used in the embodiment is not specifically limited. However, aluminum sulfate, aluminum chloride, and aluminum tanning agents which are generally and commercially available as a leather tanning agent are preferably used. These aluminum salts may be used alone or in combination of two or more. The aluminum salt concentration of the aluminum salt aqueous solution is preferably 0.3 to 40% by mass, and more preferably 0.5 to 20% by mass in the conversion of aluminum oxide. In the case where the aluminum salt concentration is smaller than 0.3% by mass, since the aluminum content in the regenerated collagen fibers is unduly decreased, the wet sensation may be degraded, or the shaping performance such as curl setting may be weakened. In the case where the aluminum salt concentration is larger than 40% by mass, the fibers may be stiff, and touch sensation may be degraded.

A time for immersing the regenerated collagen fibers in the aluminum salt aqueous solution is preferably 10 minutes or more, and more preferably 30 minutes or more. In the case where the immersion time is shorter than 10 minutes, reaction of aluminum salt is less likely to progress, which may provide insufficient improvement in wet sensation of regenerated collagen fibers, and lower the shaping performance such as curl setting. The upper limit of the immersion time is not specifically limited. However, the immersion time is preferably within 25 hours, because 25 hours allows reaction of aluminum salt to sufficiently progress, provides a desirable wet sensation, and a desirable shaping performance such as curl setting.

An inorganic salt such as sodium chloride, sodium sulfate, or potassium chloride may be added according to needs so that the inorganic salt in the concentration of 0.1 to 20% by mass, and preferably 3 to 10% by mass is included in the aluminum salt aqueous solution to prevent concentration non-uniformity resulting from rapid absorption of the aluminum salt into the regenerated collagen fibers. Further preferably, an organic salt such as sodium formate or sodium citrate may be added according to needs so that the organic salt in the concentration of 0.1 to 2% by mass, and preferably 0.2 to 1% by mass is included in the aluminum salt aqueous solution to desirably stabilize the aluminum salt in water.

The regenerated collagen fibers treated with the aluminum salt is then subjected to water-rinsing, oiling, and drying. Water-rinsing can be performed by rinsing the regenerated collagen fibers with flowing water for 10 minutes to 4 hours. An example of an oil to be used in oiling is an oil comprised of an emulsion such as amino-modified silicone, epoxy-modified silicone, or polyether-modified silicone; and a Pluronic type polyether antistatic agent. The drying temperature is preferably 100° C. or lower, and more preferably 75° C. or lower. Preferably, a load in a drying step is performed in a gravitational condition using 0.01 to 0.25 g in weight, and preferably 0.02 to 0.15 g in weight per 1 dtex.

Water-rinsing is performed to prevent a likelihood that: the oil may be eluted by the salt; the salt in the regenerated collagen fibers may be salted out in a drying step in a dryer, thereby cutting the regenerated collagen fibers; and the salt may fly in the dryer and adhere to a heat exchanger in the dryer, thereby lowering a heat transfer coefficient. Performing the oiling step is advantageous in preventing gelatinization of fibers in the drying step, and improving surface condition.

The regenerated collagen fibers in the embodiment have excellent color appearance, and excellent aesthetic property such as less fiber shrinkage or a like advantage. Also, the regenerated collagen fibers have high dye fastness. Specifically, the regenerated collagen fibers have excellent dye fastness such that some examples show grade 2 or higher, and even some examples show grade 4 or higher in a dye fastness test against sweat, which will be described later.

Accordingly, the regenerated collagen fibers in the embodiment are advantageously applied to various hair accessories, specifically, artificial hair to be used as e.g. head ornaments such as wigs or hairpieces, or hair for dolls, in which an aesthetic property is one of the important factors as products.

EXAMPLES

In the following, the invention is more specifically described by way of examples, but the invention is not limited thereto.

First, various dyes used in the examples are described.

(1:1 Type Metal Complex Salt Dye)
- Neolan Yellow GR 175% (dye having color index (C.I) 99 of Ciba Specialty Chemicals)
- Neolan Bordeaux RM 200% (dye having C.I 194 of Ciba Specialty Chemicals)
- Neolan Blue 2G 250% (dye having C.I 158 of Ciba Specialty Chemicals)

(1:2 Type Metal Complex Salt Dye)
- Irgalan Yellow GRL 200% (dye having C.I 116 of Ciba Specialty Chemicals)
- Irgalan Bordeaux EL 200% (dye having C.I 251 of Ciba Specialty Chemicals)
- Irgalan Blue 3GL 200% (dye having C.I 171 of Ciba Specialty Chemicals)

(Reactive Dye)
- Levafix Brilliant Blue E-BRAN (dye having C.I 114 of Dystar Japan Ltd.)
- Levafix Brill. Red E-RN gran (Dystar Japan Ltd.)
- Levafix Golden Yellow E-G (dye having C.I 27 of Dystar Japan Ltd.)
- Eriofast RedB (Ciba Specialty Chemicals)
- Cibacron Red P-BN GRAN (Ciba Specialty Chemicals)
- Lanasol Red 6G (dye having C.I 84 of Ciba Specialty Chemicals)

(Chrome Dye)
- Dimond BlackT01 (Dystar Japan Ltd.)

(Milling Dye)
- Polar Blue RLS 200% (Ciba Specialty Chemicals)
- Polar Red B 125% (dye having C.I 249 of Ciba Specialty Chemicals)
- Polar Yellow 4G 160% (Ciba Specialty Chemicals)
- Suminol Milling Brilliant Red 3BN (Ciba Specialty Chemicals)

(Leveling Acid Dye)
- Telon Red FRL Micro (Dystar Japan Ltd.)
- Telon Red M-BL 168% FRL (Dystar Japan Ltd.)
- Supranol Yellow 4GL (Dystar Japan Ltd.)

(Direct Dye)
- SiriusBlack VSFH/C (Dystar Japan Ltd.)

In the following, a method for producing regenerated collagen fibers used in the examples is described.

<Production of Regenerated Collagen Fibers>

A split leather from bovine was used as a raw material, and 30 g of a diluted hydrogen peroxide aqueous solution of 30% by mass was poured to 1200 g of alkali-solubilized leather fragments (180 g in collagen component), and the mixture was dissolved in a lactic acid aqueous solution. Thereby, a stock solution of pH 3.5 and 7.5% by mass in solid content was prepared. The stock solution was stirred and defoamed under a de-pressurized state by a stirring defoamer (model 8DMV of Dalton Ltd.). Thereafter, the mixture was transferred to a piston type spinning stock solution tank, and was allowed to stand still under a depressurized state for defoaming. Thereafter, the stock solution was extruded by a piston, and the stock solution of a fixed amount was fed constantly by using a gear pump. After filtration through a sintered filter of 10 μm in pore diameter, the stock solution was ejected into a coagulation bath containing 20% by mass of sodium sulfate (whose pH was adjusted to pH 11 by boric acid and sodium hydroxide) at 25° C. through a yarn spinning nozzle of 0.275 mm in pore diameter, 0.5 mm in pore length, and 300 in pore number at a spinning speed of 5 m/minute.

Next, the regenerated collagen fibers (300 fibers, 20 m) were immersed in a 4 kg-aqueous solution containing 1.7% by mass of epichlorohydrin (Nakarai Tesque Inc.), 0.8% by mass of sodium hydroxide (Nakarai Tesque Inc.), and 19% by mass of sodium sulfate (Tosoh Corporation) at 25° C. for 4 hours, while allowing the solution to flow.

Then, for metal tanning, the immersed regenerated collagen fibers were taken out from the aqueous solution, rinsed with flowing water for 30 minutes, and immersed in a 4 kg-aqueous solution containing 6% by mass of basic aluminum sulfate (Lutan-BN of BASF Corporation, hereinafter, the same product was used), and 0.5% by mass of sodium formate (Nakarai Tesque Inc.) at 30° C. for 15 hours, while allowing the solution to flow.

Then, the obtained fibers were washed with flowing water for 2 hours.

Then, a part of the obtained fibers was immersed in a bath filled with an oil comprised of amino-modified silicone as an emulsion and a Pluronic type polyether antistatic agent for adhesion of the oil. Thereafter, the fiber bundles were dried in a hot-air convection dryer (PV-221 of Tabai Espec Corp.) at 50° C. for 2 hours in a tensed condition that one end of the fiber bundle was fixed and 2.8 g-weight was suspended to each fiber at the other end of the fiber bundle. Thus, regenerated collagen fibers of 78 dtex per monofiber fineness, and 870,000 dtex per total fibers fineness were obtained.

Examples, Comparative Examples, and Reference Examples

The regenerated collagen fibers were dyed by the following method.

<Dyeing Treatment>

The fiber bundles of the regenerated collagen fibers were treated in a bath containing a refining agent (a neutral detergent of Kao Corporation) of 1 to 2 g/L at a temperature of 40 to 50° C. for 10 to 15 minutes for removal of the oil, followed by sufficient water-rinsing. Thereafter, the fiber bundles were dried in a hot-air dryer at 60° C. for 30 minutes. Thereby, regenerated collagen fiber bundles before dyeing were obtained.

Next, fiber bundles each of 50 g and 20 cm in fiber length were obtained from the regenerated collagen fiber bundles free of the oil, and one end of each fiber bundle was fixed with a binding band.

Dye aqueous solutions were prepared in a pot dyeing machine, using the dyes shown in Table 1 dissolved in water. Then, the pH of the respective dye aqueous solutions were adjusted to the values shown in Table 1, and the liquid amount of each dye aqueous solution was set to satisfy a liquid ratio of 1:40. The temperature of each aqueous solution was kept at 20 to 30° C. The fiber bundles were immersed in the respective aqueous solutions.

Next, the temperatures of the dye aqueous solutions immersed with the fiber bundles were raised to the respective corresponding dyeing temperatures shown in Table 1 at a temperature raising speed of about 3° C./min. After the fiber bundles were immersed in the dye aqueous solutions at the respective dyeing temperatures for 60 minutes, the fiber bundles were taken out from the dye aqueous solutions, and rinsed with water for 10 minutes.

<Fixing Treatment>

The dyed regenerated collagen fibers rinsed with water for 10 minutes in the dyeing step were treated by one of the treatment methods.

Example

Treatment with Condensation Compound of Polyalkylenepolyamine Dicyanamide Aqueous Solution (pH 9)

A hydrochloride of a condensation compound of polyalkylenepolyamine and dicyandiamide (fix oil RGS of Meisei Chemical Works, Ltd.) of 4 parts by mass was dissolved in water of 100 parts by mass, followed by addition of sodium carbonate. Thereby, a 3.8% polyalkylenepolyamine aqueous solution of pH 9 was obtained. Then, after the regenerated collagen fibers were immersed in the aqueous solution at a bath ratio of 1:40 at 60° C. for 20 minutes, the regenerated collagen fibers were taken out from the aqueous solution, and rinsed with water for 10 minutes. After the water-rinsing, the regenerated collagen fibers were dried in a homogeneously-heat air dryer at 60° C. for 1 hour. Thereby, polyalkylenepolyamine of 10% omf was included in the regenerated collagen fibers.

Example

Treatment with Aqueous Solution of Hydrochloride of Condensation Compound of Polyalkylenepolyamine and Dicyandiamide A hydrochloride of condensation compound of polyalkylenepolyamine and dicyandiamide (Neo Silk Fix 85 of Tokai Seiyu Ltd.) of 2.5 parts by mass was dissolved in water of 100 parts by mass, followed by pH adjustment to pH 9. Thus, a 3.8% aqueous solution of hydrochloride of condensation compound of polyalkylenepolyamine and dicyandiamide was obtained. Then, after the regenerated collagen fibers were immersed in the aqueous solution at a bath ratio of 1:40 at 60° C. for 20 minutes, the regenerated collagen fibers were taken out from the aqueous solution, and rinsed with water for 10 minutes. After the water-rinsing, the regenerated collagen fibers were dried in a homogeneously-heat air dryer at 60° C. for 1 hour. Thereby, a hydrochloride condensation product of 8% omf was included in the regenerated collagen fibers.

Example

Treatment with Condensation Compound of Polyalkykenepolyamine Dicyanamide Aqueous Solution (pH 5)

A hydrochloride of a condensation compound of polyalkylenepolyamine and dicyandiamide (fix oil RGS of Meisei Chemical Works, Ltd.) of 4 parts by mass was dissolved in water of 100 parts by mass. Thereby, a 3.8% polyalkylenepolyamine aqueous solution of pH 5 was obtained. Then after the regenerated collagen fibers were immersed in the aqueous solution at a bath ratio of 1:40 at 60° C. for 20 minutes, the regenerated collagen fibers were tAken out from the aqueous solution, and rinsed with water for 10 minutes. After the water rinsing, the regenerated collagen fibers were dried in a homogeneously-heat air dryer at 60° C. for 1 hour. Thereby, polyalkylenepolyamine of 2.8% omf was included in the regenerated collagen fibers.

Comparative Example

No Fixing Treatment

The regenerated collagen fibers were dried in a homogeneously-heat air dryer at 60° C. for 1 hour, without immersion in a fixing agent aqueous solution.

Comparative Example

Treatment with Dicyandiamide Aqueous Solution

Dicyandiamide (fix oil 3F of Meisei Chemical Works, Ltd.) of 4 parts by mass was dissolved in water of 100 parts by mass, followed by addition of sodium carbonate. Thereby, a 3.8% dicyandiamide aqueous solution of pH 9 was obtained. Then, after the regenerated collagen fibers were immersed in the aqueous solution at a bath ratio of 1:40 at 60° C. for 20 minutes, the regenerated collagen fibers were taken out from the aqueous solution, and rinsed with water for 10 minutes. After the water-rinsing, the regenerated collagen fibers were dried in a homogeneously-heat air dryer at 60° C. for 1 hour. Thereby, dicyandiamide of 4% omf was included in the regenerated collagen fibers.

Comparative Example

Treatment with 0.74% Synthetic Tannin Aqueous Solution

A synthetic tannin (SZ-9904 of Dainippon Pharmaceutical Co., Ltd.) of 0.75 parts by mass was dissolved in water of 100 parts by mass. Thereby, a 0.74% synthetic tannin aqueous solution of pH 6 was obtained. Then, after the regenerated collagen fibers were immersed in the aqueous solution at a bath ratio of 1:40 at 60° C. for 20 minutes, the regenerated collagen fibers were taken out from the aqueous solution, and rinsed with water for 10 minutes. After the water-rinsing, the regenerated collagen fibers were dried in a homogeneously-heat air dryer at 60° C. for 1 hour. Thereby, synthetic tannin of 3% omf was included in the regenerated collagen fibers.

Comparative Example

Treatment with 3.8% Synthetic Tannin Aqueous Solution

A synthetic tannin (SZ-9904 of Dainippon Pharmaceutical Co., Ltd.) of 4 parts by mass was dissolved in water of 100 parts by mass. Thereby, a 3.8% synthetic tannin aqueous solution of pH 6 was obtained. Then, after the regenerated collagen fibers were immersed in the aqueous solution at a bath ratio of 1:40 at 60° C. for 20 minutes, the regenerated collagen fibers were taken out from the aqueous solution, and rinsed with water for 10 minutes. After the water-rinsing, the regenerated collagen fibers were dried in a homogeneously-heat air dryer at 60° C. for 1 hour. Thereby, synthetic tannin of 15% omf was included in the regenerated collagen fibers.

Comparative Example

Treatment with 0.25% Natural Tannic Acid Aqueous Solution and Tartar Emetic Aqueous Solution A natural tannic acid (High Fix SW-A of Dainippon Pharmaceutical Co., Ltd.) of 0.25 parts by mass was dissolved in water of 100 parts by mass. Thereby, a 0.25% natural tannic acid aqueous solution of pH 6 was obtained. Then, the regenerated collagen fibers were immersed in the aqueous solution at a bath ratio of 1:40 at 60° C. for 20 minutes so that natural tannic acid of 1% omf was included in the regenerated collagen fibers.

Then, the regenerated collagen fibers were immersed in a tartar emetic aqueous solution (0.05 g/L) at 60° C. for 20 minutes so that tartar emetic of 2% omf was included in the regenerated collagen fibers. After water-rinsing, the regenerated collagen fibers were dried in a homogeneously-heat air dryer at 60° C. for 1 hour. Thereby, natural tannic acid and tartar emetic were included in the regenerated collagen fibers.

Comparative Example

Treatment with 3.8% Natural Tannic Acid Aqueous Solution and Tartar Emetic Aqueous Solution A natural tannic acid (High Fix SW-A of Dainippon Pharmaceutical Co., Ltd.) of 4 parts by mass was dissolved in water of 100 parts by mass. Thereby, a 3.8% natural tannic acid aqueous solution of pH 6 was obtained. Then, the regenerated collagen fibers were immersed in the aqueous solution at a bath ratio of 1:40 at 60° C. for 20 minutes so that the natural tannic acid of 15% omf was included in the regenerated collagen fibers.

Then, the regenerated collagen fibers were immersed in a tartar emetic aqueous solution (0.05 g/L) at 60° C. for 20 minutes so that tartar emetic of 2% omf was included in the regenerated collagen fibers. After water-rinsing, the regenerated collagen fibers were dried in a homogeneously-heat air dryer at 60° C. for 1 hour. Thereby, natural tannic acid and tartar emetic were included in the regenerated collagen fibers.

Comparative Example

Treatment with Aqueous Solution Containing Aluminum Sulfate and Sodium Carbonate Aluminum sulfate of 0.0075 g and sodium carbonate of 0.125 g were dissolved in water of 100 parts by mass. Thereby, an aluminum sulfate-sodium carbonate aqueous solution was obtained. Then, the regenerated collagen fibers were immersed in the aqueous solution at a liquid ratio of 1:40 at 60° C. for 20 minutes. By the immersion, aluminum sulfate of 3% omf and sodium carbonate of 5% omf were included in the regenerated collagen fibers. Since the treated regenerated collagen fibers shrunk greatly, it was judged that the regenerated collagen fibers were improper for use.

<Evaluation>

The dyed regenerated collagen fibers produced by the aforementioned method were evaluated by the following method.

[Dye Exhaustion Rate]

The dye exhaustion rate (%) was calculated by the equation: $(A-B)/A\times100(\%)$, where A (%) represents a concentration of the dye aqueous solution before dyeing, and B (%) represents a concentration of the dye aqueous solution after dyeing. The respective concentrations were calculated based on an ultraviolet absorption of the dyes with respect to a characteristic absorption wavelength.

[Color Appearance Test]

Color appearances of the dyed regenerated collagen fibers were evaluated by the following method.

A spectrophotometer (CM-2600d of Konica Minolta) was used to measure a hue.

After the regenerated collagen fibers without a fixing treatment were cut into fiber bundles of a predetermined length, the fiber bundles were combed three times. Thereafter, the fiber bundles were placed on a horizontal table, and color measurement at any two points of each fiber bundle was performed. Then, an average value of measurement values was obtained. The hue measurement in the invention was performed with a diffusion illumination of 10°, a light receiving optical system of D65, a measurement diameter of 8 mm, and an SCE system.

In the case where a color difference ($\Delta E$) between the average value of hue obtained by the above method, and a target color to be obtained by a predetermined dyeing prescription was less than 1, the color appearance was judged to be good. In the case where the color difference was 1 or more, the color appearance was judged to be not good.

[Shrinkage Rate after Dyeing]

The length of monofiber of the dyed regenerated collagen fibers without a fixing treatment was measured. Then, a shrinkage rate of the length of monofiber after dyeing with respect to the length of monofiber before dyeing was measured by setting the length of monofiber before dyeing to 100%.

[Dye Fastness Test Against Sweat]

A fastness test was performed by the following method in conformity with JIS L-0848 (ISO 105-E04).

Specifically, L-histidine hydrochloride monohydrate (0.5 g), sodium chloride (5 g), and disodium hydrogenphosphate 12-hydrate (5 g) were dissolved in water, followed by addition of about 25 ml of 0.1 mol/L sodium hydroxide aqueous solution and water so that the pH of the resultant solution was 8.0 and the total volume thereof was adjusted to about 1 L. Thus, an alkali artificial sweat solution was prepared.

Further, regenerated collagen fiber samples each of a predetermined weight were sandwiched between two pieces of white cloth (nylon cloth or cotton cloth of 10 cm×4 cm), and four sides of each two cloth pieces were stitched. Thereby, composite test samples were obtained. Each composite test sample was immersed in the alkali artificial sweat solution at a bath ratio of 50:1 at room temperature for 30 minutes.

Each composite test sample was held between two glass rods, and wrung out to such an extent that the alkali artificial sweat solution was not dripped. After the composite test samples were pressurized at about 12.5 kPa, using a sweat test machine specified according to the specifications, the composite test samples were put in a dryer at a temperature of 37±2° C., and held for about 4 hours. After the drying, the stitched white cloth pieces were separated, and the separated cloth pieces were dried at a temperature not exceeding 60° C. The degree of stain of the white cloth was visually evaluated based on the following criteria, using a predefined grayscale for use in determining stain.

excellent: not lower than grade 4 and not higher than grade 5 fair: not lower than grade 2 and lower than grade 4 poor: not lower than grade 1 and lower than grade 2

Evaluation results are shown in Table 1 and Table 2.

TABLE 1

| sample No. | kind of dye | dye and concentration | dyeing condition pH | dyeing condition water temperature (° C.) | exhaustion rate (%) | color appearance test color | color appearance test color difference | shrinkage rate (%) |
|---|---|---|---|---|---|---|---|---|
| 1 | 1:1 type metal complex salt dye | Neolan Yellow GR 175% (1.36% omf) | 2.5 | 60 | 92 | yellow | good | 3 |
| 2 | 1:1 type metal complex salt dye | Neolan Bordeaux RM 200% (0.75% omf) | 2.5 | 60 | 95 | red | good | 3 |
| 3 | 1:1 type metal complex salt dye | Neolan Blue 2G 250% (0.72% omf) | 2.5 | 60 | 93 | blue | good | 2 |
| 4 | 1:2 type metal complex salt dye | Irgalan Yellow GRL 200% (1.7% omf) | 4 | 60 | 90 | yellow | good | 3 |
| 5 | 1:2 type metal complex salt dye | Irgalan Bordeaux EL 200% (0.9% omf) | 4 | 60 | 89 | red | good | 2 |
| 6 | 1:2 type metal complex salt dye | Irgalan Blue 3GL 200% (3.5% omf) | 4 | 60 | 91 | blue | good | 3 |
| 7 | reactive dye | Eriofast Red B (2.0% omf) | 4 | 30 | 99 | red | good | 3 |
| 8 | reactive dye | Cibacron Red P-BN GRAN(2.0% omf) | 4 | 65 | 91 | red | good | 3 |
| 9 | reactive dye | Lanasol Red 6G (2.0% omf) | 4 | 40 | 99 | red | good | 4 |
| 10 | chrome dye | Dimond Black T01 (2.0% omf) | 4 | 60 | 80 | black | good | 3 |
| 11 | milling acid dye | Polar Red B125% (2.0% omf) | 4 | 30 | 99 | red | good | 3 |
| 12 | milling acid dye | Suminol Milling Brilliant Red 3BN (2.0% omf) | 4 | 40 | 90 | red | good | 2 |
| 13 | leveling acid dye | Telon Red FRL Micro (2.0% omf) | 4 | 40 | 90 | red | good | 3 |
| 14 | direct dye | SiriusBlackVSFH/C(2.0% omf) | 4 | 60 | 50 | gray | not good | 3 |
| 15 | reactive dye | Levafix Brilliant Blue E-BRA (0.76% omf) | 4 | 60 | 85 | black | good | 4 |
| | | Levafix Brill. Red E-RN gran (0.2% omf) | | | 85 | | | |
| | | Levafix Golden Yellow E-G 150% (1.04% omf) | | | 97 | | | |
| 16 | reactive dye | Levafix Brilliant Blue E-BRA (0.76% omf) | 7 | 60 | 92 | black | good | 2 |
| | | Levafix Brill. Red E-RN gran (0.2% omf) | | | 93 | | | |
| | | Levafix Golden Yellow E-G 150% (1.04% omf) | | | 96 | | | |
| 17 | reactive dye | Levafix Brilliant Blue E-BRA (0.76% omf) | 10 | 60 | 95 | black | good | 4 |
| | | Levafix Brill. Red E-RN gran (0.2% omf) | | | 95 | | | |
| | | Levafix Golden Yellow E-G 150% (1.04% omf) | | | 97 | | | |
| 18 | 1:1 type metal complex salt dye | Neolan Yellow GR 175% (1.36% omf) | 2.5 | 60 | 92 | black | good | 4 |
| | | Neolan Bordeaux RM 200%(0.75% omf) | | | 95 | | | |
| | | Neolan Blue 2G 250% (0.75% omf) | | | 93 | | | |
| 19 | 1:2 type metal complex salt dye | Irgalan Yellow GRL 200% (1.7% omf) | 4 | 60 | 90 | black | good | 3 |
| | | Irgalan Bordeaux EL 200% (0.9% omf) | | | 89 | | | |
| | | Irgalan Blue 3GL 200% (3.5% omf) | | | 91 | | | |
| 20 | milling acid dye | Polar Blue RLS 200% (0.81% omf) | 2 | 60 | 45 | green | not good | 25 |
| | | Polar Red B 125% (0.15% omf) | | | 50 | | | |
| | | Polar Yellow 4G 160%(1.04% omf) | | | 64 | | | |
| 21 | leveling acid dye | Telon Fast Blue M-GN 167% (0.76% omf) | 2 | 60 | 27 | purple | not good | 28 |
| | | Telon Red M-BL 168% (0.20% omf) | | | 24 | | | |
| | | Supranol Yellow 4GL(1.04% omf) | | | 25 | | | |
| 22 | 1:1 type metal complex salt dye | Neolan Yellow GR 175% (1.36% omf) | 1.5 | 60 | 92 | black | good | 35 |
| | | Neolan Bordeaux RM 200% (0.75% omf) | | | 94 | | | |
| | | Neolan Blue 2G 250% (0.72% omf) | | | 92 | | | |
| 23 | reactive dye | Levafix Brilliant Blue E-BRA (0.76% omf) | 4 | 100 | 95 | black | good | 45 |
| | | Levafix Brill. Red E-RN gran (0.2% omf) | | | 96 | | | |
| | | Levafix Golden Yellow E-G 150% (1.04% omf) | | | 97 | | | |
| 24 | reactive dye | Levafix Brilliant Blue E-BRA (0.76% omf) | 4 | 75 | 90 | black | good | 16 |
| | | Levafix Brill. Red E-RN gran (0.2% omf) | | | 91 | | | |
| | | Levafix Golden Yellow E-G 150% (1.04% omf) | | | 97 | | | |
| 25 | reactive dye | Levafix Brilliant Blue E-BRA (0.76% omf) | 11 | 60 | 47 | blue | not good | 22 |
| | | Levafix Brill. Red E-RN gran (0.2% omf) | | | 41 | | | |
| | | Levafix Golden Yellow E-G 150% (1.04% omf) | | | 6 | | | |

TABLE 2

| | example | | | | | | | | | comparative example | | | | | |
|---|---|---|---|---|---|---|---|---|---|---|---|---|---|---|---|
| | 3.8% PAPA aqueous solution (pH 9) | | | hydrochloride of condensation compound of PAPA-DCDA (pH 9) | | | 3.8% PAPA aqueous solution (pH 5) | | | no treatment | | | DCDA aqueous solution (pH 9) | | |
| sample No. | nylon (grade) | cotton (grade) | total evaluation | nylon (grade) | cotton (grade) | total evaluation | nylon (grade) | cotton (grade) | total evaluation | nylon (grade) | cotton (grade) | total evaluation | nylon (grade) | cotton (grade) | total evaluation |
| 1 | 4~5 | 4~5 | excellent | 4~5 | 5 | excellent | 3 | 3 | fair | 1 | 1 | poor | 3 | 3 | fair |
| 2 | 4~5 | 4~5 | excellent | 5 | 5 | excellent | 3 | 3 | fair | 1 | 1 | poor | 3 | 3 | fair |
| 3 | 4~5 | 4~5 | excellent | 5 | 5 | excellent | 3 | 3 | fair | 1 | 1 | poor | 3 | 3 | fair |
| 4 | 4~5 | 4~5 | excellent | 4~5 | 4~5 | excellent | 3 | 3 | fair | 1 | 1 | poor | 3~4 | 3~4 | fair |
| 5 | 4~5 | 4~5 | excellent | 4~5 | 4~5 | excellent | 3 | 3 | fair | 1 | 1 | poor | 3~4 | 3~4 | fair |
| 6 | 4~5 | 4~5 | excellent | 5 | 5 | excellent | 3 | 3 | fair | 1 | 1 | poor | 3~4 | 3~4 | fair |
| 7 | 4~5 | 4~5 | excellent | 5 | 5 | excellent | 3 | 3 | fair | 2 | 1 | poor | 3 | 3 | fair |
| 8 | 4~5 | 4~5 | excellent | 5 | 5 | excellent | 3 | 3 | fair | 2 | 1 | poor | 3 | 3 | fair |
| 9 | 5 | 5 | excellent | 5 | 5 | excellent | 3 | 3 | fair | 2~3 | 1 | poor | 3 | 3 | fair |
| 10 | 4~5 | 4~5 | excellent | 4~5 | 5 | excellent | 3 | 3 | fair | 1~2 | 1 | poor | 2~3 | 2~3 | fair |
| 11 | 4~5 | 4~5 | excellent | 4~5 | 4~5 | excellent | 3 | 3 | fair | 2 | 1 | poor | 2~3 | 2~3 | fair |
| 12 | 4~5 | 4~5 | excellent | 4~5 | 4~5 | excellent | 3 | 3 | fair | 2 | 1 | poor | 2~3 | 2~3 | fair |
| 13 | 4~5 | 4~5 | excellent | 4~5 | 4~5 | excellent | 3 | 3 | fair | 2~3 | 1 | poor | 2~3 | 2~3 | fair |
| 14 | — | — | — | — | — | — | — | — | — | — | — | — | — | — | — |
| 15 | 4 | 4~5 | excellent | 4 | 4~5 | excellent | 3 | 3 | fair | 1~2 | 2 | poor | 3~4 | 3 | fair |
| 16 | 4 | 4~5 | excellent | 4 | 4~5 | excellent | 3 | 3 | fair | 1~2 | 2 | poor | 3~4 | 3 | fair |
| 17 | 4 | 4~5 | excellent | 4 | 4~5 | excellent | 3 | 3 | fair | 1~2 | 2 | poor | 3 | 3 | fair |
| 18 | 5 | 5 | excellent | 5 | 5 | excellent | 3 | 3 | fair | 2 | 1~2 | poor | 3~4 | 3 | fair |
| 19 | 4~5 | 4~5 | excellent | 4~5 | 4~5 | excellent | 3 | 3 | fair | 2 | 1~2 | poor | 3 | 3 | fair |
| 20 | — | — | — | — | — | — | — | — | — | — | — | — | — | — | — |
| 21 | — | — | — | — | — | — | — | — | — | — | — | — | — | — | — |
| 22 | — | — | — | — | — | — | — | — | — | — | — | — | — | — | — |
| 23 | 5 | 5 | excellent | 5 | 5 | excellent | — | — | — | — | — | — | — | — | — |
| 24 | — | — | — | — | — | — | — | — | — | — | — | — | — | — | — |
| 25 | — | — | — | — | — | — | — | — | — | — | — | — | — | — | — |

| | comparative example | | | | | | | | | | | |
|---|---|---|---|---|---|---|---|---|---|---|---|---|
| | 0.74% synthetic tannin aqueous solution (pH 6) | | | 3.8% synthetic tannin aqueous solution (pH 6) | | | 0.25% natural tannic acid aqueous solution (pH 6) | | | 3.8% natural tannic acid aqueous solution (pH 6) | | |
| sample No. | nylon (grade) | cotton (grade) | total evaluation | nylon (grade) | cotton (grade) | total evaluation | nylon (grade) | cotton (grade) | total evaluation | nylon (grade) | cotton (grade) | total evaluation |
| 1 | 2 | 2~3 | fair | 2 | 2~3 | fair | 2 | 2~3 | fair | 2 | 2~3 | fair |
| 2 | 2 | 2~3 | fair | 2 | 2~3 | fair | 2 | 2 | fair | 2 | 2 | fair |
| 3 | 2 | 2~3 | fair | 2 | 2~3 | fair | 2~3 | 2~3 | fair | 2~3 | 2~3 | fair |
| 4 | 2 | 2 | fair | 2 | 2 | fair | 2~3 | 2~3 | fair | 2~3 | 2~3 | fair |
| 5 | 2 | 2~3 | fair | 2 | 2~3 | fair | 2 | 2~3 | fair | 2 | 2~3 | fair |
| 6 | 2 | 2~3 | fair | 2 | 2~3 | fair | 2 | 2~3 | fair | 2 | 2~3 | fair |
| 7 | 2 | 2~3 | fair | 2 | 2~3 | fair | 2 | 2~3 | fair | 2 | 2~3 | fair |
| 8 | 2~3 | 2~3 | fair | 2~3 | 2~3 | fair | 2 | 2 | fair | 2 | 2 | fair |
| 9 | 2~3 | 2 | fair | 2~3 | 2 | fair | 2 | 2~3 | fair | 2 | 2~3 | fair |
| 10 | 2~3 | 2 | fair | 2~3 | 2 | fair | 2 | 2~3 | fair | 2 | 2~3 | fair |
| 11 | 2 | 2 | fair | 2 | 2 | fair | 2 | 2 | fair | 2 | 2 | fair |
| 12 | 2 | 2 | fair | 2 | 2 | fair | 2 | 2~3 | fair | 2 | 2~3 | fair |
| 13 | 2 | 2 | fair | 2 | 2 | fair | 2 | 2~3 | fair | 2 | 2~3 | fair |

TABLE 2-continued

| | | | | | | | | | | | | |
|---|---|---|---|---|---|---|---|---|---|---|---|---|
| 14 | — | — | — | — | — | — | — | — | — | — | — | — |
| 15 | 2~3 | 2~3 | fair | 2~3 | 2~3 | fair | 2 | 2~3 | fair | 2~3 | 2~3 | fair |
| 16 | 2~3 | 2~3 | fair | 2~3 | 2~3 | fair | 2 | 2~3 | fair | 2~3 | 2~3 | fair |
| 17 | 2~3 | 2~3 | fair | 2~3 | 2~3 | fair | 2 | 2~3 | fair | 2~3 | 2~3 | fair |
| 18 | 3 | 3 | fair | 3 | 3 | fair | 2~3 | 2~3 | fair | 2~3 | 2~3 | fair |
| 19 | 2~3 | 2~3 | fair | 2~3 | 2~3 | fair | 2~3 | 2~3 | fair | 2~3 | 2~3 | fair |
| 20 | — | — | — | — | — | — | — | — | — | — | — | — |
| 21 | — | — | — | — | — | — | — | — | — | — | — | — |
| 22 | — | — | — | — | — | — | — | — | — | — | — | — |
| 23 | — | — | — | — | — | — | — | — | — | — | — | — |
| 24 | — | — | — | — | — | — | — | — | — | — | — | — |
| 25 | — | — | — | — | — | — | — | — | — | — | — | — |

PAPA: Polyalkylenepolyamine, DCDA: Dicyandiamide

The fiber sample Nos. 1 through 13, and 15 through 19 in Table 1 all had excellent color appearance, and the fiber shrinkage rate before and after dyeing thereof was less than 5%. On the other hand, the fiber sample Nos. 20 through 22 dyed with a dye aqueous solution of pH less than 2.5, the fiber sample Nos. 23 through 24 dyed at a dyeing temperature higher than 70° C., and the fiber sample No. 25 dyed with a dye aqueous solution of pH 11 all had a high shrinkage rate. The fiber sample No. 14 dyed with a direct dye had a low dye exhaustion rate.

Concerning the fiber sample Nos. 1 through 13, and 15 through 19 having excellent color appearance and fiber shrinkage rate before and after the dyeing of less than 5% in the fastness test result in which the respective fixing treatments were performed shown in Table 2, it is clear that the regenerated collagen fibers of example treated with a polyalkylenepolyamine aqueous solution of pH 9 shows a high dye fastness. It is also clear that the regenerated collagen fibers treated with an aqueous solution of hydrochloride of condensation compound of polyalkylenepolyamine and dicyandiamide shows a high dye fastness. On the other hand, the fibers of comparative example without a fixing treatment had very poor dye fastness. In the case where the fibers were treated with a natural tannin aqueous solution or a synthetic tannin aqueous solution, significant improvement on dye fastness was not observed. Also, in the case where the fibers were treated with a dicyandiamide aqueous solution, significant improvement on dye fastness was not observed. In the case where the fibers were treated with an aqueous solution containing aluminum sulfate and sodium carbonate, the fibers showed a large shrinkage. Accordingly, the fibers were not used to evaluate the fastness.

As described above, an aspect of the invention is directed to a dyed regenerated collagen fiber containing at least one kind of a compound selected from the group consisting of polyalkylenepolyamine compounds, condensation compounds of polyalkylenepolyamine and dicyandiamide, and acid addition salt compounds of the condensation compounds. As compared with the other protein fibers, a regenerated collagen fiber has a high affinity to water. Accordingly, the regenerated collagen fiber has relatively low dye fastness, as compared with the other protein fibers. However, inclusion of the aforementioned compound enables to produce a regenerated collagen fiber having an excellent aesthetic property, and high dye fastness, particularly, high fastness against sweat, as compared with a case of using a conventional general dye fixing agent e.g. tannin, aluminum sulfate, or sodium carbonate. Accordingly, in the case where the dyed regenerated collagen fiber of the invention is used as artificial hair, the dye can be securely fixed in the regenerated collagen fiber, while suppressing color fading of the dye resulting from hair washing or sweat, and color transfer to a garment or the like.

In the case where a fastness of the dyed regenerated collagen fiber is grade 2 or higher in a fastness test according to JIS L-0848 with respect to a nylon white cloth and a cotton white cloth using an alkali artificial sweat solution, the dye fastness of the dyed regenerated collagen fiber is excellent.

Preferably, the dyed regenerated collagen fiber may contain the compound of 1 to 20% omf in the aspect of sufficiently increasing the dye fastness.

Preferably, the dyed regenerated collagen fiber may be a fiber dyed with at least one kind of a dye selected from the group consisting of 1:1 type metal complex salt dyes, 1:2 type metal complex salt dyes, leveling acid dyes, milling acid dyes, chrome dyes, and reactive dyes. The aforementioned dyes have a high exhaustion rate with respect to regenerated collagen fibers. Accordingly, the above arrangement enables to obtain a dyed regenerated collagen fiber having a vivid color appearance.

In the case where the dyed regenerated collagen fiber is a fiber dyed with at least one kind of a dye selected from the group consisting of 1:1 type metal complex salt dyes, 1:2 type metal complex salt dyes, and reactive dyes, and the dye is multiple different dyes belonging to the selected species, dyed regenerated collagen fibers with ample variations of color tones are obtained, because the respective dyes has a high exhaustion rate.

Another aspect of the invention is directed to an artificial hair fiber comprising the dyed regenerated collagen fiber. The artificial hair fiber has a texture close to human hair, excellent color appearance, and excellent dye fastness such as sweat fastness.

Another aspect of the invention is directed to a method for fixing a dye in a dyed regenerated collagen fiber comprising the steps of immersing a dyed regenerated collagen fiber in an aqueous solution of at least one kind of a compound selected from the group consisting of polyalkylenepolyamine compounds, condensation compounds of polyalkylenepolyamine and dicyandiamide, and acid addition salt compounds of the condensation compound s; and drying the immersed dyed regenerated collagen fiber at a predetermined temperature. The dyed regenerated collagen fiber produced by the above method is a regenerated collagen fiber having excellent dye fastness.

Preferably, the pH of the aqueous solution may be adjusted in the range of 8 to 10. In the case where the pH is adjusted in the aforementioned manner, a dyed regenerated collagen fiber with a higher fastness is obtained.

In the case where the dyed regenerated collagen fiber is a dyed fiber obtained by immersing a regenerated collagen fiber in an aqueous solution of least one kind of a dye selected from the group consisting of 1:1 type metal complex salt dyes, 1:2 type metal complex salt dyes, leveling acid dyes, milling acid dyes, chrome dyes, and reactive dyes at 70° C. or lower, a dyed regenerated collagen fiber with less fiber shrinkage is obtained, while maintaining a high dye exhaustion rate.

The invention claimed is:

1. A method for fixing a dye in a dyed regenerated collagen fiber, comprising the steps of:

dyeing a regenerated collagen fiber with an aqueous solution of least one kind of a dye selected from the group consisting of 1:1 type metal complex salt dyes, 1:2 type metal complex salt dyes and reactive dyes, and then immersing a dyed regenerated collagen fiber in an aqueous solution of hydrochloride of condensation compounds of polyalkylenepolyamine and dicyandiamide for 10 to 30 minutes so that the condensation compounds form a hydrogen bond to a carboxyl group in the regenerated collagen fiber; and drying the immersed dyed regenerated collagen fiber at a predetermined temperature, wherein the pH of the aqueous solution is in the range of 8.5 to 9.5 and the temperature there of is in the range of 55 to 65° C.

2. The method for fixing a dye in a dyed regenerated collagen fiber according to claim 1, wherein the dyed regenerated collagen fiber is a dyed fiber obtained by immersing a regenerated collagen fiber in a dye aqueous solution at 70° C. or lower.

3. The method for fixing a dye in a dyed regenerated collagen fiber according to claim 1, wherein the dyed regenerated collagen fiber is a dyed fiber obtained by immersing a regenerated collagen fiber in a dye aqueous solution in the range of pH 2 to 10.

4. A method for producing a dyed regenerated collagen fiber comprising:

a dyeing step of immersing a regenerated collagen fiber in an aqueous solution of least one kind of a dye selected from the group consisting of 1:1 type metal complex salt dyes, 1:2 type metal complex salt dyes and reactive dyes;

followed by a dye fixing step of immersing the dyed regenerated collagen fiber in an aqueous solution of hydrochloride of condensation compounds of polyalklenepolyamine and dicyandiamide for 10 to 30 minutes so that the condensation compounds form a hydrogen bond to a carboxyl group in the regenerated collagen fiber; and a drying step of drying the immersed dyed regenerated collagen fiber at a predetermined temperature, wherein the pH of the aqueous solution is in the range of 8.5 to 9.5 and the temperature thereof is in the range of 55 to 65° C. in the dye fixing step.

5. The method for producing a dyed regenerated collagen fiber according to claim 4, wherein the regenerated collagen fiber is immersed in the dye aqueous solution at 70° C. or lower in the dyeing step.

6. The method for producing a dyed regenerated collagen fiber according to claim 4, wherein the regenerated collagen fiber is immersed in the dye aqueous solution in the range of pH 2 to 10 in the dyeing step.

* * * * *